United States Patent [19]

Buerner

[11] 4,184,261

[45] Jan. 22, 1980

[54] MULTIPURPOSE DRAFTING AND MEASURING INSTRUMENT

[75] Inventor: Wolfgang P. Buerner, Pasadena, Calif.

[73] Assignee: Los Angeles Scientific Instrument Co., Inc., Los Angeles, Calif.

[21] Appl. No.: 893,985

[22] Filed: Apr. 6, 1978

Related U.S. Application Data

[63] Continuation of Ser. No. 757,765, Jan. 7, 1977, abandoned.

[51] Int. Cl.[2] ..... B43L 13/00

[52] U.S. Cl. ..... 33/18 R; 33/1 M

[58] Field of Search ..... 33/1 C, 1 M, 18 R, 79 R, 33/121-124, 141 R, 141 B, 141 C, 141 D, 141 E, 141.5; 346/29; 235/446

[56] References Cited

U.S. PATENT DOCUMENTS

| | | | |
|---|---|---|---|
| 2,033,715 | 3/1936 | Jacob | 33/79.1 X |
| 3,166,844 | 1/1965 | Pascoe et al. | 33/79 R |
| 3,328,801 | 6/1967 | Boyle et al. | 346/31 |
| 3,564,220 | 2/1971 | Peddie et al. | 235/92 R |
| 3,573,842 | 4/1971 | Colpitts | 33/18 R X |
| 3,656,169 | 4/1972 | Kashio | 346/75 |
| 3,696,397 | 10/1972 | Raser | 33/1 M |
| 3,758,949 | 4/1971 | Fausel et al. | 33/1 M |

*Primary Examiner*—Charles E. Phillips
*Attorney, Agent, or Firm*—Sellers and Brace

[57] ABSTRACT

A multipurpose drafting and measuring instrument having an upright marking device mounted on a base or main frame readily maneuverable over sheet material. Mounted on the instrument main frame are one or more signal generators each having a roller in frictional driving contact with the sheet material and with their axes normal to one another and to a respective peripheral edge of the instrument base. The signal generators are connected to respective digital display panels each having a manually settable scale changer. Any of a variety of marking devices can be substituted for one another. The instrument includes various readily attached accessories for utilizing the instrument as an Y, X digitizer, a protractor, a planimeter, and both as a linear and a circular scale graduator.

42 Claims, 8 Drawing Figures

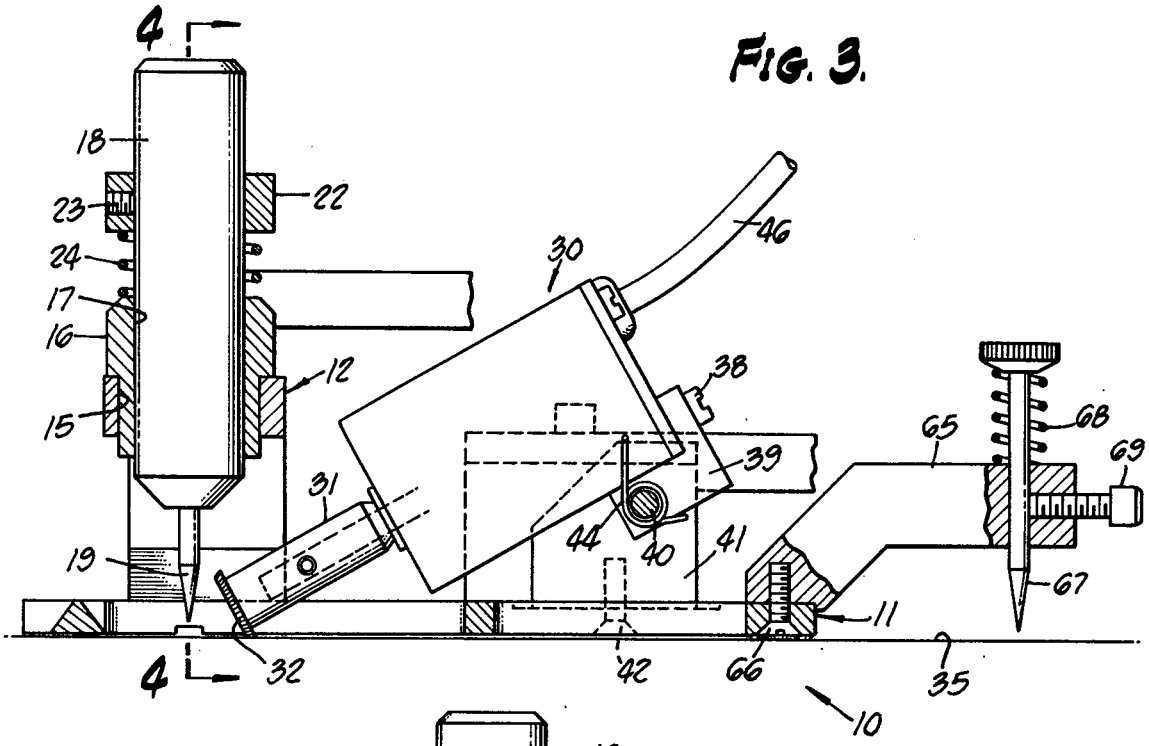
FIG. 3.
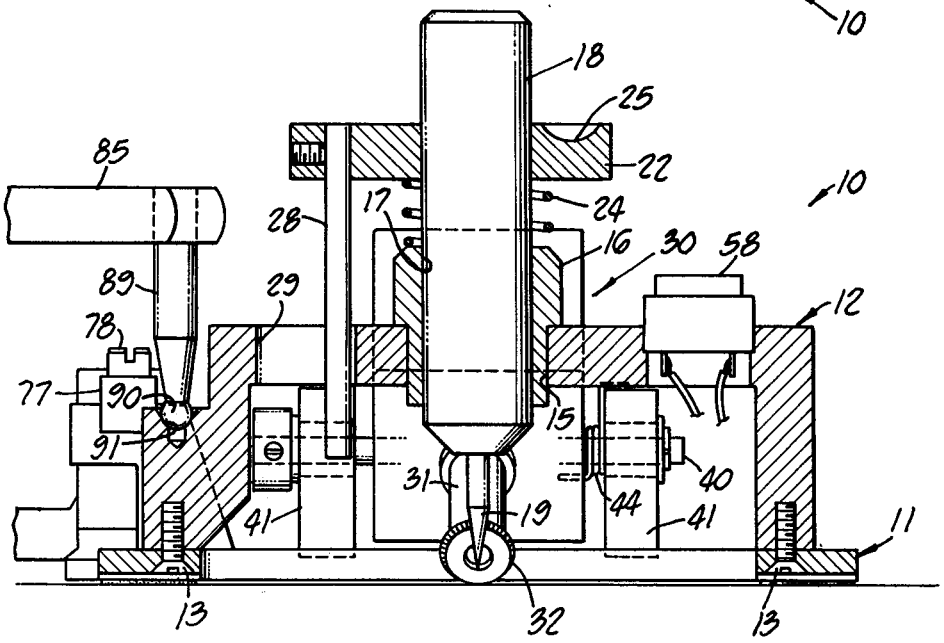
FIG. 4.
FIG. 7.
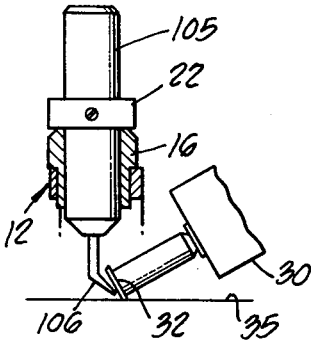
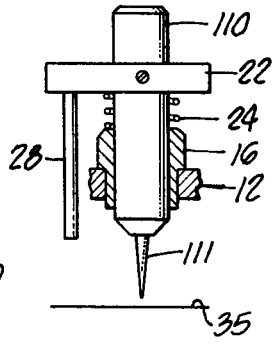
FIG. 8.

MULTIPURPOSE DRAFTING AND MEASURING INSTRUMENT

This application is a continuation of my pending application for U.S. Ser. No. 757,765, filed Jan. 7, 1977, now abandoned, entitled MULTIPURPOSE DRAFTING AND MEASURING INSTRUMENT.

This invention relates to measuring instruments, and more particularly to a unique electronic multiple purpose drafting and measuring apparatus utiliziable with various accessories for performing a variety of drafting and measuring operations to high precision and including electronic numerical readout together with manual scale changing means.

BACKGROUND OF THE INVENTION

Many proposals have been made heretofore for both mechanical and electronic measuring instruments. In general, these prior proposals involve measuring instruments specially designed for a particular application or purpose although some have the capability of performing more than one type of operation. All are subject to various disadvantages and shortcomings avoided by the present invention including high cost, excessive bulk and weight and, in particular, inability to perform various drafting operations and measuring chores normally associated with or related to layout and drafting operations. Illustrative prior art measuring instrument devices are disclosed in the following U.S. Pat. Nos.: Mentzel 2,557,450; Murrah 2,867,908; Henson et al. 3,012,328; Pascoe et al. 3,166,844; Lowy, 3,172,208; Engelsman 2,498,959; Lineback 3,412,238; Paulson 3,601,585; Zeldler 3,688,410; Peddle 3,544,773; Boyce 3,654,449; Peddle 3,564,220; Welch et al. 3,683,159; Raser 3,696,397; Culver et al. 3,728,551; Fausel 3,758,949 and Colbourn 3,912,926.

No one of these prior patents discloses an instrument capable of performing numerous drafting operations such as penciling, inking, scratching; none is suitable for use as a protractor or angle measuring or graduating device. Only Peddle U.S. Pat. No. 3,564,220 discloses an electronic measuring instrument which can be utilized to measure irregular plots or configurations. Raser depends upon the use of a massive main frame mounted on a carriage which must be moved in a strictly straight path as a long draft arm used to propel the device is pivoted laterally of the path of travel as necessary for a pointer on that arm to follow an underlying irregular trace. The carriage and arm drive separate semipolar encoders the readings of which must be processed into a computer using trigonometric relationships to convert the readings rectangular or cartesion coordinates. Fausel's non-portable two dimensional digitizer apparatus is mounted on a large table top and includes a scribe the movement of which in any planar direction is transmitted to separate X and Y readout counters by an exposed cable and pulley system and lacking the features and capabilities of this invention. Pascoe et al. differs from Fausel principally by substituting electrical components for Fausel's cable and pulley system. Colbourn discloses only a specific type of opto-electronic incremental encoder for sensing precise increments of shaft rotation. There are electronic area measuring devices available commercially such as, for example, various planimeter instruments manufactured by the assignee of the present invention. However, these instruments are restricted to use as planimeters and mechanical integrators and are lacking in the versatility and wide variety of other uses served so efficiently and effectively by the present invention.

THE INVENTION

The basic component of the present invention is a unitary assembly readily grasped by the hand and comprises a support for a wide range of different markers or marking devices equipped with a high precision signal generator activated by a roller in frictional driving contact with a supporting surface and providing operating signals to a digital display device providing readout value representing a maneuvering manipulation or excursion of the instrument. The device includes quickly changeable scaling means for introducing any desired scaling factor into the signal increments to represent any desired scale. In a typical commercial embodiment, the instrument increments represent one mil when measuring linear movements and one minute of arc when measuring angular movements.

The base of the marker support rests directly upon the surface of sheet material and includes perimeter guide surfaces lying at right angles to one another with one lying normal to the axis of the signal generating roller. The basic unit serves protracting functions when equipped with a pole arm having a pivot pin at its outer end. Other accessories include clamping means for securing the marker support to the scale of a drafting machine and a tracer arm accessory. When equipped with a tracer arm and means for securing the marker support to a drafting machine, the device provides a high precision X, Y digitizer operating substantially instantly to provide the X, Y coordinate values of any selected point within an X, Y quadrant. The device also provides a high precision planimeter by substituting a planimeter pole arm in lieu of the bracket employed to clamp the marker support to a drafting machine.

It is therefore a primary object of this invention to provide a novel, high precision, electronic measuring and drafting device.

Another object of the invention is the provision of a versatile multipurpose electronic drafting instrument selectively usable for conventional pen or ink drafting and layout operations as well as for planimeter operation, Y, X digitizing operations, as a protractor, as means for measuring the distance between two or more points along a line of any configuration, and other related operations.

Another object of the invention is the provision of a support for any one of a plurality of different marking devices in combination with a precision signal generator equipped with electronic readout digital display and scale changing means.

Another object of the invention is the provision of an electronic X, Y coordinate digitizing device operatively connected to digital display and scale changing means.

Another object of the invention is the provision of an electronic protractor provided with signal generating means and digital display means capable of measuring and graduating arcs to an accuracy of one minute.

Another object of the invention is the provision of a measuring and layout instrument capable of marking or measuring lines of any configuration to an accuracy of one mil.

Another object of the invention is the provision of an electronic layout and measuring instrument usable selectively as a planimeter, a protractor, and as an X, Y digitizer.

These and other more specific objects will appear upon reading the following specification and claims and upon considering in connection therewith the attached drawing to which they relate.

Referring now to the drawing in which a preferred embodiment of the invention is illustrated:

FIG. 3 is a cross-sectional view on an enlarged scale taken along line 3—3 on FIG. 2;

FIG. 4 is a cross-sectional view of the basic instrument taken along line 4—4 on FIG. 3; and FIGS. 5, 6, 7 and 8 are fragmentary views of different marker constructions selectively insertable in a support therefor on the basic instrument.

Figure 1:
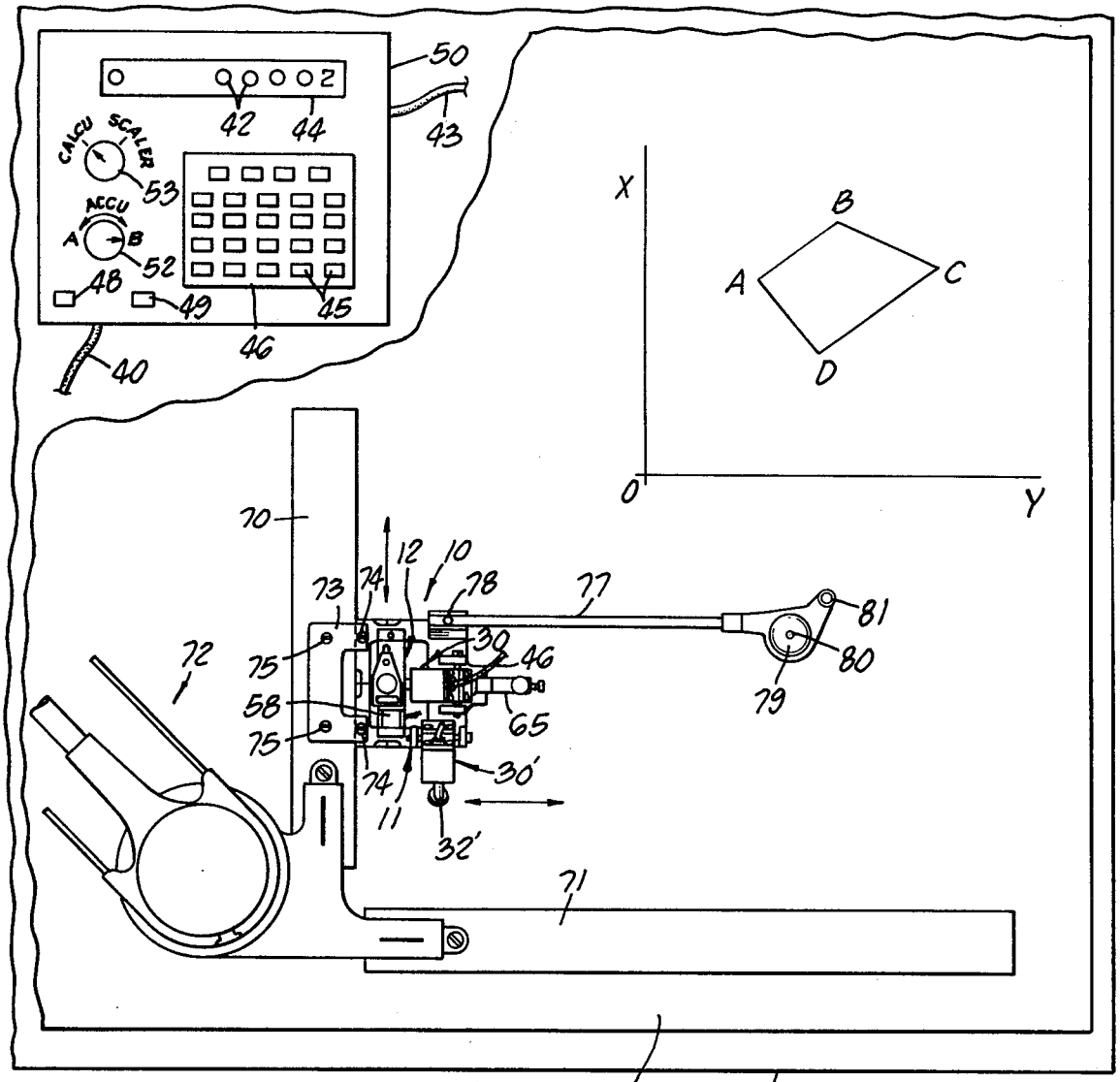
FIG. 1 is a fragmentary plan view of an illustrative embodiment of the invention layout and measuring instrument equipped for use as an X, Y digitizer.

Referring initially, more particularly to FIGS. 1, 3 and 4, there is shown an illustrative drafting and measuring instrument, designated generally 10, provided with a generally hollow, rectangular main frame or base 11 to which is rigidly secured an inverted generally U-shaped bridge 12. Both base 11 and bridge 12, but at least the base component, is preferably made of transparent material such as a tough plastic suitably secured together as by screws 13 (FIG. 4). All outer exterior edges of base 11 can be utilized as guide surfaces and are accurately finished to lie at right angles to one another.

Referring more particularly to FIGS. 3 and 4, it is pointed out that bridge 12 is provided with a bore 15 firmly seating an open-ended marking device receiver comprising a bearing member 16 having a precision central bore 17. This bore is designed to receive and reciprocally support any of a variety of special function markers but, as shown in FIGS. 3 and 4, bore 17 is in use to support a marker 18 having a sharp tip 19 at its lower end. When not in use, this tip is preferably held spaced slightly above the lower supporting surface of base 11 by a marker activator subassembly comprising a collar 22 held firmly secured to the stylus by a set screw 23 and a rotation control post 28 extending loosely into a slot 29 in bridge 12. Interposed between the top of bearing member 16 and the underside of collar 22 is a light compression spring 24. Collar 22 projects radially from the opposite sides of a marking device body 18 to provide a depression 25 seating the tip of the operator's index finger while depressing the marking device into contact with a supporting surface. The rotation control post 28 depends from the opposite side of the collar and extends loosely through a slot 29 formed in bridge 12 and cooperates with slot 29 in preventing rotation of the marker and the possibility of error which could result from such rotation.

The precision measuring component of the instrument comprises an electrical signal generator, designated generally 30, having a signal generating shaft 31 projecting from one end thereof and secured to a precision roller 32. This roller has a slightly serrated periphery providing positive, frictional driving contact with an underlying surface such as a map, drawing paper or other sheet material 35 supported on a drawing board, table 36 or the like supporting surface. Firmly secured to generator 30, as by screws 38, is a bracket 39 journalled on a shaft 40. The opposite ends of this shaft are supported by brackets 41 integral with base 11 or held assembled thereto as by screws 42. Generator 30 is spring biased into light but firm contact with surface 35 by gravity or preferably by a torsion spring 44. One end of this spring is anchored to generator 30 and the other bears against a stationary part of the main frame.

The signal generator 30 may be of any suitable type capable of generating a multiplicity of electrical pulses or signals representing very small discreet rotary movements of roller 32. Typically, generator 30 is designed to generate 1,000 signals for each complete rotation of roller 32. A generator suitable for these purposes is disclosed in U.S. Pat. No. to Colbourn 3,912,926, granted Oct. 14, 1975.

The generated signals are fed to a digital display and scale changer unit 50 by lead wires 40. Unit 50 may have a self-contained power supply or be connected to any suitable power supply by a service cord 43. Unit 50 is equipped with electronic digital readout symbols 42 arranged in a row visible through window 44. These digits may be set to read out on a 1 to 1 scale or any other desired scale by manually depressing the appropriate buttons 45 for operating an electronic computer 46 of known construction. A digital display and scale changer unit 50 having these features is obtainable commercially as Model L50-sl manufactured and sold by Los Angeles Scientific Instrument Company, Inc., located at 2451 Riverside Dr., Los Angeles, Calif. 90039. Any other digital display unit having the same or similar performance capabilities can be utilized to process and display the signals from generator 30.

Unit 50 includes data entry button 48 depressed to enter scale factor data or other data generated in the computer unit 50 into the information storage facility utilized in processing the signals from generator 30 before this information is displayed in digital form in window 44. Knob 52 is shiftable between positions A and B depending upon whether the instrument is being used to accumulate positive or negative data. When the knob is in the A position, negative data is collected whereas positive data is collected and registered as gathered when the knob is in the B position. If knob 52 is positioned midway between A and B, the electronic data storage is disconnected from the signal generator without losing any stored information or data. This permits instrument 10 to be moved to the starting point of the next operating excursion without risk of altering previously collected data to store new data as soon as knob 52 is turned to either of the data storing positions A or B.

Knob 53 is shiftable between two positions, namely, the left or calculating position and the right hand or scaling position. When turned to the first mentioned position, calculations previously made on computer 46 can be entered into the data storage facility of the digital display subassembly. This knob can be utilized to perform calculating operations or for deriving any desired scaling factor. After it has been computed the new scale factor constant is entered on the storage facility. If it is desired to continue use of this same factor then it is retained in storage by turning knob 53 to the "scaler" position whereupon the stored constant is utilized automatically in processing all subsequent signals emanating from signal generator 30 before the results are displayed digitally in window 44.

It is also pointed out that both the digit display unit 50 and the basic instrument are preferably provided with separate "clear" buttons or the like each operable to reset the digit readout elements to zero. To this end instrument 10 is provided with a "clear" or reset button 58 (FIG. 4) conveniently located on bridge 12 whereas a similar "clear" button 49 is positioned on the front face of display unit 50 (FIG. 1).

If measuring instrument 10 is to be employed as a protractor it is equipped with a pole piece 65 (FIG. 3) rigidly secured to base 11 as by screws 66. This pole piece extends rearwardly from signal generator 30 with its longitudinal axis lying in the plane of the axis of the signal generator drive roller 32. Reciprocally supported in the rear end of pole piece 65 is a sharp pointed pivot pin 67 normally biased upwardly by a compression spring 68. Desirably a thumb screw 69 holds pin 67 firmly either in its retracted position shown in FIG. 3 or in a depressed operating position penetrating the surface of the sheet material 35 on which the instrument rests. When the pin is depressed firmly into the sheet material and locked there by thumb screw 69, instrument 10 can be swung in an arc about the axis of pin 67.

If the distance between the axis of pin 67 and the rim of wheel 32 is pi and signal generator 30 is designed to emit or generate 1,000 pulses or signals per inch of travel, then each signal produced by movement of the instrument about the axis of pin 67 represents one minute of arc and 60 separate signals represent a movement of 1° of arc. If a sharp pointed marker 18 is mounted in the instrument, its sharp point 19 can be depressed as the instrument is rotated about pivot pin 67 at any selected interval or after any selected number of signals represented by an equal number of digits displayed in window 44 of display unit 50. Usually, the marker will be depressed to prick a point in sheet 35 to indicate the location of each selected travel increment. Thus, if the increment is 1°, 2° or 5°, then the instrument is held stationary while the marker is depressed to prick a point in the surface representing the terminal of each increment of travel. And this is true whether the selected interval is one representing any drafting position or one representing a unit of a scale being calibrated to any selected one of an infinite number of different scales.

If measuring instrument 10 is to be used as an X, Y digitizer, then the instrument main frame is rigidly secured to one arm 70 of a typical conventional drafting machine, designated generally 72, and shown in part in FIG. 1. Instrument 10 is rigidly secured to scale arm 70 by a bracket 73 and cap screws 74,75. One edge of the instrument base 11, such as the edge parallel to the axis of shaft 31 and roller 32, is held firmly against the adjacent edge of scale arm 70 during this assembly operation.

A second digitizer accessory comprises a tracer arm 77 which is rigidly clamped to main frame 11 by a screw 78 with its main axis parallel to the adjacent perimeter edge of main frame 11. The outer end of tracer arm 77 is provided with a magnifying lens 79, a suitable reticle 80, and an upright finger grip or handle 81. This handle is utilized to maneuver the instrument to position reticle 80 accurately centered over the particular point the coordinants being ascertained by the instrument. A third digitizer accessory comprises a second signal generator 30′ preferably of identical construction to generator 30 detachably securable to base 11 similarly to generator 30. The pivot support mounting brackets for generator 30′ are clamped to base 11 by assembly screws with the axis of its precision roller 32′ lying accurately perpendicular to the axis of roller 32 of the first signal generator. Generator 30′ is used with a digit display and scale changer unit, not shown, but which is preferably a duplicate of unit 50 shown in FIG. 1. Accordingly, the movement of each of the rollers 32, 32′ is accurately measured and displayed in the display window of the associated one of the digit display units. For example, when the digitizer is assembled to a drafting machine as shown in FIG. 1, display unit 50 will display increments of instrument movement along the X axis whereas generator 30′ will measure units of movement along the Y axis.

The X, Y axis lines appearing in FIG. 1 represent the first quadrant and a polygon A, B, C, D is shown laid out in this quadrant. The X, Y coordinants of the points A, B, C, D are quickly determined to high precision in the following manner. The drafting machine is moved over the quadrant until the sharp point 19 of marker 18 is precisely over the zero position or the intersection points of the X and Y axes. Thereupon the "clear" button 49 of each digit display unit 50 is depressed thereby restoring all digit elements to their respective zero position. Drafting machine 72 is then moved to position point 19 of the marker directly over point A of the polygon whereupon the digit readings in the display window of each unit is read and recorded as the precise X and Y coordinants of point A. Thereafter the operator proceeds to determine the X and Y coordinants of each of the other points B, C and D.

Figure 2:
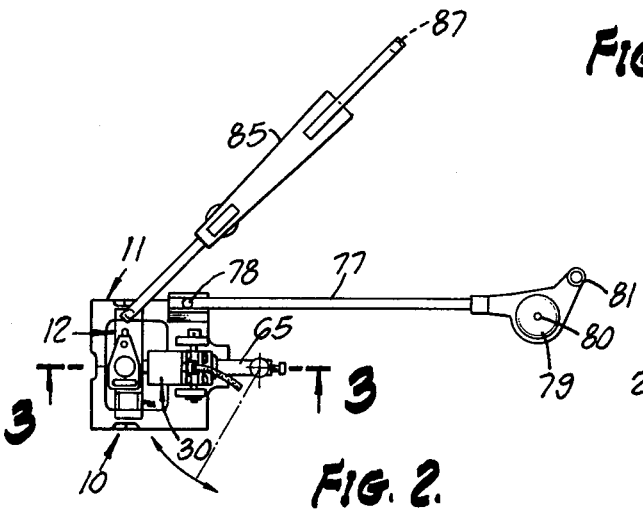
FIG. 2 is a top plan view on a reduced scale of the basic instrument equipped with a pole arm and a tracer arm for use as a planimeter.
Figure 5:
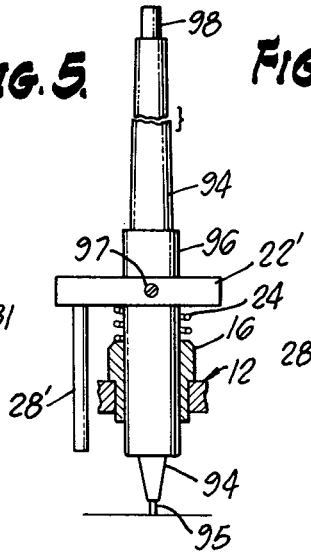

If instrument 10 is to be employed as a planimeter, the basic measuring instrument 10 is equipped with the pole arm 85 and the tracer arm 77 described above. The outer end of pole arm 85 is equipped with a conventional type pivot pin 87 depending from its underside. This pivot pin is either depressed firmly into an underlying support surface or journalled in a well formed in a heavy base piece, not shown, resting firmly and immovably on a supporting surface as the remainder of the planimeter is moved in known manner about the perimeter of the arc. The opposite or left-hand end of pole arm 35 as viewed in FIG. 2 is equipped with a pivot pin 89 (FIG. 4) having a ball 90 on its lower end socketed in a conical well 91 formed in an upwardly facing surface of bridge 12 of the measuring instrument in the manner clearly shown in FIG. 4. The operation of the planimeter will be described in greater detail presently.

Referring now to FIGS. 5 to 8 inclusive, there is shown several additional marker subassemblies which can be employed with the basic measuring instrument in lieu of the sharp pointed marker 18, 19. Marker 94 shown in FIG. 5 comprises an inking pen having a precision small diameter inking nib 95 projecting from its lower end. Marker 94 is frictionally and firmly mounted in a sleeve 96 having the same exterior diameter as the upper end of marker 18 shown in FIG. 4. Marker 94 and sleeve 96 may be firmly clamped in collar 22′ by a thumb screw 97 in a position such that spring 24 will normally support these components with nib 95 spaced slightly above the surface of sheet material 35 when the marker subassembly is mounted in member 16 of the measuring instrument. As here shown the inking marker is provided with a push-pull nib retractor 98 of any conventional construction and functioning to retract the nib within its shroud when not in use and to expose the nib end when the pen is in use.

Figure 6:
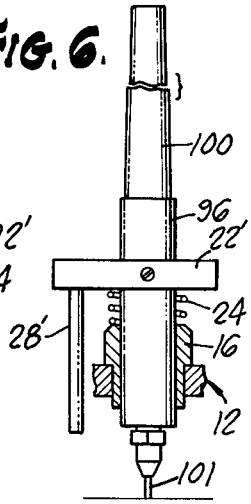

FIG. 6 shows a penciling marker likewise firmly mounted within a retaining sleeve 96. This marker is likewise provided with a collar 22′, a rotation control post 28′ and a spring 24 supporting the pencil lead out of contact with sheet 35 when not in use. The lower end of the penciling marker is provided with an adjustable feed for a very fine precision lead 101 which functions to clamp a desired length of the lead in an exposed marking position. This marker accessory is likewise readily substituted for any one of the other marker assemblies disclosed herein.

FIG. 7 shows a linear measuring marking device 105 having a generally L-shaped sharp-pointed tip 106 extending from its lower end and shaped to position its terminal end as close as possible to the point of contact of measuring wheel 32 with sheet 35. There is no need for depressing this device and accordingly spring 24 is omitted and collar 22 rests against the upper end of bearing 16. A rotation control post 28 is concealed from view in FIG. 7 but will be understood as present to hold the tip of prong 106 against movement directly underlying the axis of roller 32.

FIG. 8 shows a scratching marker clamped in members 22,28 and having a diamond scratching tip 111 normally supported by spring 24 out of contact with sheet material 35. The scratching marker is employed in scratching a trace of any desired configuration in conventional tinted film material such as Mylar and the like tinted layout films. The scratches cut through the tint layer with the result that the layout work prepared in this manner can be employed as a negative in making any desired number of reproductions.

In view of the detailed description and operating characteristics of the basic instrument and its accessories set forth above, only a brief resume of the operating procedure will be necessary. Basic instrument 10 is utilizable in a wide variety of layout and drafting operations most of which employ a selected one of the various markers insertable into the marker receiver 16. All except the FIG. 7 marking device normally employ spring 24 to maintain the lower end of the marking device resiliently spaced above the surface.

Assuming that the marker shown in FIG. 8 is being utilized and that it is desired to determine the length of meandering trace representing a road, stream or the like on an underlying map, the instrument is placed on the map with the marker tip 111 directly over the starting point. The map scale being known, the operator then proceeds to manipulate computer 46 of display unit 50 to generate the scale factor representing that scale. For example, if the scale is 1" representing 5 miles, the operator manipulates the computer to divide 5 by the number of signals per linear inch generated by generator 30. Assuming that this number is 1,000 pulses or signals, the operator divides 5 by 1,000 thereby providing a scale factor of 0.005. Knob 35 is now turned to the right as viewed in FIG. 1 so that its pointer is opposite the legend "scaler". Data entry button 48 is then depressed to enter the above mentioned scale factor then present in the computer into the memory of the digital display unit 50. The operator proceeds to manipulate instrument 10 as necessary to move tip 19 of the marker along the road or other configuration being measured. As this operation takes place the digits appearing instantly in window 44 will present a continuous representation of the distance traversed. If the operator wishes to clear the reading at any time and start over or to begin a new operation he simply depressed either clear button 49 or clear button 58 on the instrument itself thereby restoring the digital register to zero.

Alternatively, if the user wishes to measure first one distance and then a second distance beginning from a different point on the map, he completes the first measuring operation and then shifts knob 52 from the B position to a vertical position midway between A and B. This operation of the knob locks the first value in the information memory facility. After the point of the marker is placed in the new position, knob 52 is restored to position B and left there during the second measuring operation. All movements along this new course are automatically and instantly added to the original reading and displayed in window 44.

Let it be assumed now that the operator wishes to perform some calculations using the accumulated value so far measured then stored in the memory and displayed in the window. He proceeds by making the requisite calculations using the electronic computer buttons of computer 46. When this operation has been completed, he turns knob 53 to the "CALCU" position and then depresses entry button 48 whereupon the result of the computing operation is utilized automatically to process the information stored in the memory cell and to display the result in window 44.

The X, Y digitizer operation has been described in major respects above when describing the components and the use thereof. The X, Y accessories comprising bracket 73, tracer arm 77, and the second signal generator 30' are secured to the basic instrument and bracket 73 is utilized to clamp this assembly to one arm, such as arm 70, of a conventional drafting machine. Also a second digital display unit identical with unit 50 has its input conductors 40 connected to a second display unit 50. Thereafter, reticle 80 is accurately positioned over the intersection of the X, Y coordinants and one of the clear buttons 49 or 58 is depressed to restore the display digits of both display units to zero. Thereupon the operator proceeds as described above to move the drafting machine to position reticle 80 over each point of the polygon to determine, in turn, the respective X, Y coordinants of each corner of the polygon A, B, C, D. After one set of coordinants has been established, one of the clear buttons is depressed to restore the display units to zero before proceeding to determine the coordinants of another point. Since all points lie within the first or positive quadrant represented in FIG. 1, knob 52 remains in position B throughout this operation.

When the instrument is in use as a planimeter the basic instrument 10 is equipped, in the manner shown in FIG. 2, with a pole arm 85 and a tracer arm 77. The marker may be omitted since reticle 80 at the outer end of the tracer arm is utilized by the user in guiding the instrument over the perimeter of the area being measured. The "clear" buttons are utilized to clear the digital display at the beginning of a tracing operation with the reticle aligned with the starting point of a tracing excursion. The numerals displayed in window 44 at the completion of the excursion then represent the area within that perimeter, it being assumed that the user has entered the proper scale factor into the display unit's memory at the start of the excursion.

If the area includes a smaller area which the user wishes to exclude from the first area measured, the user first sets knob 52 in its central position at the end of the first measurement to lock the memory against change and then proceeds to set reticle 80 at the starting point of an excursion about the second area, then turns knob 52 to position A whereupon he proceeds to complete a measuring excursion about the smaller area.

Since knob 52 when in the A position introduces negative values into the digital display component, the display window will present digits representing the first area minus the smaller second area at the completion of the second measuring excursion.

The basic unit can also be used with any one of the several markers by simply inserting the selected marker into marker receiver 16. If it is desired to make a pencil layout to a particular scale, the operator inserts pencil marking device 94 into the receiver, shifts the instrument to position the pencil point over the starting point of the line to be drawn, enters the appropriate scale factor into the display unit, clears the digital display, and proceeds to move the instrument along a straight edge such as the edge of a T-square, a triangle, or a french curve, until the displayed digits of unit 50 indicate that a line of a desired length has been made. During this excursion the pencil marking device is held depressed by placing the finger tip in depression 25 of the marking device activator 22 and pressing downwardly. An accurately dimensioned layout drawing to any desired scale can be quickly and easily completed without need for other measuring instruments of any kind. Thereafter, the pencil layout may be converted to ink by substituting the inking marker 100 for the pencil marker.

Protractor and arc measuring and graduating operations can be performed equally efficiently and accurately utilizing the protractor pole arm accessory 65 illustrated in FIG. 3 along with an appropriate one of the several markers.

While the particular multipurpose drafting and measuring instrument herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

I claim:

1. A multipurpose drafting instrument comprising in combination:

main frame means adapted to be grasped by the operator's hand and moved as a unit planarly in both linear and non-linear paths over sheet material while performing a precision drafting operation;

movement sensing signal generator means mounted on said main frame means having roller means adapted to rest in driving contact with said sheet material and including digital display means responsive to said signals to represent rotary movement of said roller means as said main frame means is moved through an operating excursion from one position to another in any linear or non-linear path; and means on said main frame means resiliently supporting a marking device with the lower end thereof normally out of contact with said sheet material until manually depressed into contact therewith and with the axis thereof lying in substantially the same vertical plane as the axis of said roller means and unrestrained against movement out of said vertical plane, whereby said marking device, said signal generator means and said digital display means mutually cooperate in performing a high precision drafting operation as said marking device and said main frame means are moved planarly in linear and non-linear paths.

2. A multipurpose drafting instrument as defined in claim 1 characterized in the provision adjacent said marking device of clearing means for resetting said display means to zero at any time.

3. A multipurpose drafting instrument as defined in claim 1 characterized in the provision of guide means on said main frame means having portions thereof lying at right angles to one another and useful in moving said marking device in either direction along a drafting scale or the like while the latter is held stationary relative to said sheet material.

4. A multipurpose drafting instrument as defined in claim 1 characterized in that said marking device support on said main frame means includes marking device receiver means adapted to detachably and reciprocally support any one of a plurality of marking devices designed to perform different functions.

5. A multipurpose drafting instrument as defined in claim 4 characterized in that the marking device selectively mountable in said marking device receiver means includes an inking marker, a pencil marker, a scratching marker and a pricking point marker.

6. A drafting instrument as defined in claim 4 characterized in the provision of spring means normally supporting said marking device in said receiver means with the lower end thereor spaced out of contact with a support surface for said instrument whereby said marking device is readily manually depressable into contact with said support surface.

7. A multipurpose drafting instrument as defined in claim 1 characterized in the provision on said main frame means of a protractor pole arm provided with pivot pin means having a sharp point adapted to be depressed into said sheet material and maintain said marking device at a selected distance from said pivot pin as said main frame means is moved in an arc over said sheet material and said digital display means displays digits representative of the length of arc traversed.

8. A drafting instrument as defined in claim 7 characterized in that said marking device has a sharp point manually depressable to prick said sheet material each time said display means indicates marking device travel through any selected number of arcuate increments.

9. A drafting instrument as defined in claim 8 characterized in that the distance between the longitudinal axes of said marking device and of said pivot pin and the arcuate travel of said marking device for each signal generated represents a predetermined increment of arc.

10. A drafting instrument as defined in claim 1 characterized in that said marking device has a sharp point manually depressable to prick said sheet material each time said display means indicates travel of said marking device through any selected number of increments.

11. A drafting instrument as defined in claim 1 characterized in the provision of means for converting said instrument to use as a planimeter comprising a pole arm and a tracer arm, said pole arm having pivot pin means protruding therefrom near one end and adapted to be depressed into said sheet material and the other end of said pole arm having a pivot connection with said main frame means adjacent said marking device, said tracer arm being rigidly securable at one end to said main frame means and having trace follower means adjacent the other end thereof to facilitate movement of said trace follower means along a line of any configuration.

12. A drafting instrument as defined in claim 11 characterized in the provision of means for resetting said digital display means to zero before beginning an operating cycle of said instrument.

13. A drafting instrument as defined in claim 11 characterized in the provision of accumulator means manually operable to store accumulated data while shifting said tracer arm to a different position to begin accumulating data for another area and then resuming an operating cycle to measure that area.

14. A drafting instrument as defined in claim 1 characterized in that said main frame means includes a vertically disposed open-ended circular bearing, a tubular sleeve having a close sliding fit in said bearing and adapted to support said marking device immovably therein, and spring means for resiliently supporting said marking device and sleeve with the lower end of said marking device closely spaced from said sheet material.

15. A drafting instrument as defined in claim 14 characterized in that said marking device and said tubular sleeve are free to be withdrawn vertically from the upper end of said circular bearing.

16. A drafting instrument as defined in claim 1 characterized in the provision of means pivotally mounting said signal generating means on said main frame means with said roller biased lightly but firmly in driving contact with said sheet material.

17. A drafting instrument as defined in claim 1 characterized in that said means for manually depressing said marking device includes means for restraining rotary movment of said marking device about the longitudinal axis thereof.

18. A drafting instrument as defined in claim 1 characterized in that said main frame means includes a base extending radially in all directions from the upright axis of said marking device and having a plurality of peripheral edges at right angles to one another with one of said edges normal to the axis of said roller means.

19. A drafting instrument as defined in claim 18 characterized in that at least portions of said base are transparent to facilitate viewing underlying portions of said sheet material as said instrument is maneuvered thereover.

20. A drafting instrument as defined in claim 1 characterized in the provision of means pivotally securing said signal generating means to said main frame means for limited pivotal movement of the axis of said roller means in a plane normal to the supporting surface on the underside of said base.

21. A drafting instrument as defined in claim 1 characterized in the provision of manually manipulatable means for introducing any desired scale factor into the signals driving said digital display means.

22. A drafting instrument as defined in claim 1 characterized in the provision of accumulator means operatively associated with said digital display means manually operable to store accumulated data while shifting said main frame means to a different position to begin an additional excursion.

23. A drafting instrument as defined in claim 1 characterized in that said instrument includes means for clamping the same to one of the vertical and horizontal scales of a conventional drafting machine and selectively usable to perform useful drafting operations while attached to as well as when detached from a conventional drafting machine.

24. A drafting instrument as defined in claim 1 characterized in that said instrument is selectively usable in combination with and independently of a drafting machine to perform any one of several different types of drafting operations.

25. A drafting instrument as defined in claim 1 characterized in the provision of means for rigidly and detachably anchoring said main frame means to a drafting machine with the axis of said roller means parallel to one arm of a drafting machine whereby said instrument and drafting machine are usable to perform unidirectional precision measured layout operations in a direction normal to the length of said one arm.

26. A drafting instrument as defined in claim 25 characterized in the provision on said main frame means of a second movement sensing signal generating means having roller means in contact with a supporting surface for said instrument and having its axis lying in a plane normal to a plane parallel to the axis of said first mentioned signal generating means, and means connecting said second signal generating means to said computer means for processing the signals therefrom concurrently with the processing of the electrical signals from said first mentioned signal generating means.

27. A motion responsive instrument having a rigid main body provided with a base designed for planar mobility in any linear and non-linear direction on a supporting surface, signal generating means mounted on said main body having a freely rotating calibrated roller positioned to have driving contact with a supporting surface for said main body and operable to generate electrical signals in response to rotation of said roller and the number of which signals is directly proportional to the bodily planar movement of said main body on said supporting surface in all directions, including non-linear directions, except directions precisely parallel to the axis of said roller, means for recording said signals as generated, and means on said main body supporting a marking device with the lower end thereof adjacent said supporting surface and with the axis thereof lying in and restrained against movement out of the same vertical plane as the axis of said roller.

28. A motion responsive instrument as defined in claim 27 characterized in that said marking device support means is adapted to detachably support a selected one of a variety of marking devices with the lower end thereof normally closely spaced axially opposite the adjacent end of said roller.

29. A motion responsive instrument as defined in claim 27 characterized in that said marking device support means includes resilient means normally effective to hold a marking device spaced close to but out of contact with a supporting surface for said instrument.

30. A motion responsive instrument as defined in claim 29 characterized in that said marking device support means includes means manually manipulatable by the user of said instrument to depress a selected marking device mounted on said main body into firm contact with a surface in contact with said roller.

31. A motion responsive instrument as defined in claim 30 characterized in the provision of computer means for processing said electrical signals from said roller means and for displaying the results as said instrument is moved across said supporting surface.

32. A motion responsive instrument as defined in claim 30 characterized in that said main body includes a protractor pivot pin having a pointed end adjustable to a position extending into penetrating contact with a supporting surface for said instrument whereby said main body is movable in an arc about the pointed end of said pivot pin, and the axis of said pivot pin and of said roller lying in a common plane whereby said instrument is usable as a protractor to measure arcs about the axis of said pivot pin.

33. A motion responsive instrument as defined in claim 30 characterized in that said main body guide surfaces lie at right angles to one another and at least one thereof parallel to a plane through the axis of said roller and normal to the supporting surface on the underside of said main body.

34. A motion responsive instrument as defined in claim 33 characterized in the provision of second signal generating means equipped with a freely rotating calibrated roller positioned to have driving contact with the supporting surface of said main body with the axis of the roller thereof lying in a vertical plane normal to a vertical plane through the axis of said first mentioned roller and normal to said supporting surface, and signal recording means operatively connected to said second signal generating means.

35. A motion responsive instrument as defined in claim 34 characterized in that each of said signal recording means is operable to record the respective X and Y coordinate values of said instrument when moved to any position within the first quadrant of an area of a supporting surface and relative to the zero position provided by the intersection of said X and Y coordinates.

36. A motion responsive instrument as defined in claim 35 characterized in the provision of means for deactivating one of said signal generating means when not needed to measure one of said X and Y coordinate values.

37. A motion responsive instrument as defined in claim 35 characterized in the provision of means for rigidly securing said instrument to one of the vertical and horizontal scales of a conventional drafting machine with the rollers of said first and second signal generating means in contact with a flat supporting surface underlying said vertical and horizontal scales.

38. A motion responsive instrument as defined in claim 27 characterized in the provision of computer means for processing said electrical signals from said roller means and for displaying the results as said instrument is moved across said supporting surface.

39. A motion responsive instrument as defined in claim 38 characterized in that said computer means includes means for temporarily storing accumulated data between more than one successive excursion of said instrument to facilitate movement of said instrument from one position to another without risk of change in the accumulated data.

40. A motion responsive instrument as defined in claim 27 characterized in the provision of pivot means for movably securing said instrument to one end of a planimeter pole arm having means at the other end thereof to pivotally anchor the same to a selected point on a supporting surface for said instrument, and means for securing one end of a tracer arm rigidly to said main body, said tracer arm being equipped at the other end thereof with reticle means to facilitate movement of said tracer arm along a selected line of any configuration.

41. That improvement in a drafting machine of the type having rigidly interconnected vertical and horizontal scales which improvement comprises:

instrument means rigidly attachable to one of said scales and operable to determine the X and Y coordinates of the underlying supporting surface relative to the intersection of said coordinates, said instrument means including a combination:

a pair of independent roller means rotatably mounted on axes lying in planes at right angles to one another with the peripheries thereof in rolling contact with a supporting surface underlying said scales and operable to generate electrical signals respectively representing the X and Y coordinate values of any position to which said vertical and horizontal scales are moved within a quadrant defined by said coordinates, pointer means reciprocably mounted on said instrument means with the point thereof spaced closely above the plane of the supporting surface for said instrument means and with the axis thereof lying in and restrained against movement out of the same vertical plane as the axis of one of said roller means, and numerical display means electrically connected to each of said signal generating means and operable to display the respective X and Y coordinate values of said pointer means as the drafting machine is moved to position said pointer means over different points on said supporting surface.

42. That improvement defined in claim 41 characterized in that said numerical display means includes scale factor adjusting means adjustable to vary said numerical display means to any one of a plurality of different scales whereby each signal increment of said signal generating means represents an increment of a selected scale.

* * * * *